US009196949B2

(12) United States Patent
Droste et al.

(10) Patent No.: US 9,196,949 B2
(45) Date of Patent: Nov. 24, 2015

(54) PANEL HAVING ELECTRICALLY CONDUCTIVE STRUCTURES

(75) Inventors: Stefan Droste, Herzogenrath (DE); Bernhard Reul, Herzogenrath (DE); Andreas Schlarb, Herzogenrath (DE); Gunther Vortmeier, Herzogenrath (DE); Christoph Degen, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 271 days.

(21) Appl. No.: 13/377,806

(22) PCT Filed: Jul. 30, 2010

(86) PCT No.: PCT/EP2010/061105
§ 371 (c)(1),
(2), (4) Date: Dec. 12, 2011

(87) PCT Pub. No.: WO2011/018361
PCT Pub. Date: Feb. 17, 2011

(65) Prior Publication Data

US 2012/0086614 A1 Apr. 12, 2012

(30) Foreign Application Priority Data

Aug. 14, 2009 (DE) ..... 10 2009 026 378

(51) Int. Cl.
*H01Q 1/32* (2006.01)
*H01Q 1/12* (2006.01)

(52) U.S. Cl.
CPC ..... *H01Q 1/1278* (2013.01); *Y10T 29/49155* (2015.01)

(58) Field of Classification Search
CPC ..... H01Q 1/32
USPC ..... 343/713
See application file for complete search history.

(56) References Cited

U.S. PATENT DOCUMENTS 5,017,933 A 5/1991 Sakurai et al.
6,903,697 B2 6/2005 Ogino (Continued)

FOREIGN PATENT DOCUMENTS

CN 1512621 A 7/2004
CN 101222082 A 7/2008

(Continued)

OTHER PUBLICATIONS

PCT International Preliminary Report on Patentabiliy (IPRP) issued on Feb. 14, 2012 for PCT Application No. PCT/EP2010/061105 filed on Jul. 30, 2010 in the name of Saint-Gobain Glass France (English and German).

(Continued)

*Primary Examiner* — Dameon E Levi
*Assistant Examiner* — Andrea Lindgren Baltzell
(74) *Attorney, Agent, or Firm* — Steinfl & Bruno LLP

(57) ABSTRACT

A pane with electrically conductive structures is described. The pane has at least two electrically conductive structures galvanically separated from each other, a galvanic separating layer on at least on one of the electrically conductive structures, and an electrical conductor on the galvanic separating layer. The galvanic separating layer galvanically separates the conductor from at least one of the structures. A method for producing the pane and a use of the same are also described.

12 Claims, 11 Drawing Sheets

(56) References Cited

U.S. PATENT DOCUMENTS

Figure 1:
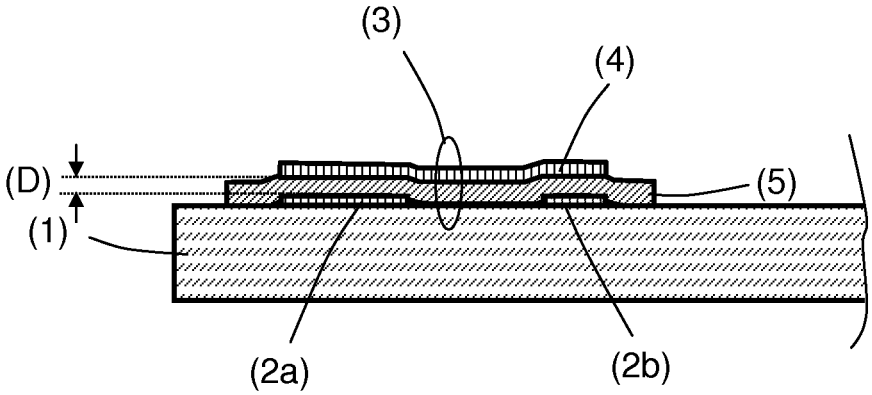

| | | | | |
|---|---|---|---|---|
| 2008/0089012 | A1* | 4/2008 | Kon et al. | 361/502 |
| 2008/0169990 | A1* | 7/2008 | Taniguchi et al. | 343/713 |
| 2008/0234895 | A1* | 9/2008 | Veerasamy | 701/36 |
| 2010/0026588 | A1* | 2/2010 | Murayama et al. | 343/700 MS |

FOREIGN PATENT DOCUMENTS

| | | | |
|---|---|---|---|
| CN | 101248553 | A | 8/2008 |
| CN | 201174421 | Y | 12/2008 |
| CN | 101345334 | A | 1/2009 |
| DE | 3910031 | | 10/1989 |
| EP | 0542473 | | 5/1993 |
| EP | 0720249 | | 7/1996 |
| JP | H08186404 | A | 7/1996 |
| JP | 2002204116 | A | 7/2002 |
| JP | 2004015534 | A | 1/2004 |
| JP | 2008054032 | A | 3/2008 |

OTHER PUBLICATIONS

PCT Search Report of International Application PCT/EP2010/061105 filed on Jul. 30, 2010 in the name of Saint-Gobain Glass France.

Office Action issued for Chinese Patent Application No. 201080035986.6 filed on Jul. 30, 2010 in the name of Saint-Gobain Glass France. Mail date: Sep. 4, 2013 (Translation + Original).

Office Action issued for Eurasian Patent Application No. 201270276 filed in the name of Saint-Gobain Glass France. Mail date: Oct. 31, 2013 (Translation + Original).

Office Action issued for Japanese Patent Application No. 2012-524186 filed in the name of Saint-Gobain Glass France. Mail date: Apr. 1, 2014 (Translation + Original).

* cited by examiner

PANEL HAVING ELECTRICALLY CONDUCTIVE STRUCTURES

CROSS REFERENCE TO RELATED APPLICATIONS

The present application is the US national stage of International Application PCT/EP2010/061105 filed on Jul. 30, 2010, which, in turn, claims priority to German Patent Application 10 2009 026 378.0 filed on Aug. 14, 2009.

The present invention relates to a novel pane with, in particular, antenna and heating capability, method for production thereof, and use thereof.

From DE 39 10 031 A1, a pane made of laminated glass that is provided with a radio antenna and pane heating is known. For optimum utilization of the area, a heating conductor is located on a first surface of the laminated glass. Parts of an antenna conductor are located on the first and or another surface of the laminated glass. Through the use of a plurality of surfaces, a relatively large area is always available for the antenna and heating capability. To improve the antenna gain, the antenna conductor and heating conductor are capacitively coupled.

There, the electrically conductive structures for the capacitive coupling must, in each case, be located directly opposite the individual heating elements on the glass surfaces. This results, in particular, in limitations in the arrangements of the antennas and heating elements on the glass surface. The capacitive coupling is associated with high signal losses over the several millimeter thickness of the glass pane.

The object of the present invention is to make available an improved pane that has efficient and simple capacitive coupling of antenna and heating conductors and, at the same time, a high degree of freedom in the arrangement of antenna and heating conductors.

In addition, the object of the present invention is to make available a method for the production of the novel pane.

The object of the invention is accomplished with the characteristics of the independent claims 1, 20, and 29. Advantageous embodiments of the invention result from the characteristics of the dependent claims.

According to the invention, a construction of a pane with electrically conductive structures is shown, which comprises a pane with at least two electrically conductive structures galvanically separated from each other, a galvanic separating layer at least on one of the electrically conductive structures, and an electrical conductor on the galvanic separating layer, wherein the galvanic separating layer separates the electrical conductor from at least one of the electrically conductive structures.

The property "galvanically separated" means that the electrically conductive structures have no electrically conductive connection and are decoupled for DC voltage.

A pane comprises, in particular, panes made of clear or tinted soda-lime glass. The panes can be thermally or chemically toughened or implemented as a laminated glass, in particular, to satisfy the Uniform Provisions concerning the Approval of Safety Glazing Materials and Their Installation on Vehicles according to ECE-R 43: 2004. The panes can also include plastics such as polystyrene, polyamide, polyester, polyvinyl chloride, polycarbonate, or polymethyl methacrylate. To adjust energy transmission, the panes can have complete or partial surface coatings with radiation absorbing, reflecting, and/or low emission properties. If the pane is implemented as a laminated glass pane, two soda-lime glasses are permanently bonded with a plastic layer containing polyvinyl butyral.

The pane can have the size customary in the automobile industry for windshields, side windows, glass roofs, or rear windows of motor vehicles, preferably from 100 $cm^2$ up to 4 $m^2$. Customary thicknesses of the panes are in the range from 1 mm to 6 mm.

The electrically conductive structures have different forms. Panes with heating and/or antenna capabilities preferably have line-shaped structures and macroscopic transparency at the same time.

Electrically conductive structures with heating capability as heating conductors are preferably configured as a number of parallel lines that are connected in parallel via busbars at least on the opposing edges of the pane. Upon application of an electric voltage between the busbars, joule heating is generated over the area of the pane. The increased temperature of the pane prevents or removes moisture and icing from the surface of the pane. The electrically conductive structure preferably extends line-shaped over virtually the entire area of the pane. Electrically conductive structures with heating capability can have different shapes, arrangements, and interconnections and are, for example, configured round, spiral-shaped, or meander-shaped. The electrically conductive structures stretch, in particular, over the interior surfaces of motor vehicle glazings.

Electrically conductive structures with antenna capability are, preferably, configured as antenna conductors in the shape of lines. The length of the antenna conductors is determined by the targeted antenna characteristics. Antenna conductors can be implemented as lines with an open or closed end, or have different shapes, arrangements, and interconnections and can be, for example, configured round, spiral-shaped, or meander-shaped.

The antenna characteristics are determined by the frequencies to be received or transmitted. The received and/or transmitted electromagnetic radiation is, preferably, LF, MF, HF, VHF, UHF, and/or SHF signals in the frequency range from 30 kHz to 10 GHz, particularly preferably, radio signals, in particular USW (30 MHz to 300 MHz, corresponding to a wavelength from 1 m to 10 m), shortwave (3 kHz to 30 MHz, corresponding to a wavelength from 10 m to 100 m), or medium wave (300 kHz to 3000 kHz, corresponding to a wavelength from 100 m to 1000 m), as well as signals of toll collection, mobile radio, digital radios, TV signals, or navigation signals. The length of the electrically conductive structures with antenna capability is, preferably, a multiple or a fraction of the wavelength of the frequencies to be transferred, in particular one half or one fourth of the wavelength. For better utilization of the surface of the pane, the electrically conductive structures can be configured curved, meander-shaped, or spiral-shaped.

Typical line widths of the electrically conductive structures according to the invention are 0.1 mm to 5 mm; typical widths of busbars or contact regions are 3 mm to 30 mm. typical distances between the electrically conductive structures in the region of the capacitive coupling are between 1 mm and 20 mm. The electrically conductive structures can themselves be opaque; however, macroscopically, the pane appears transparent.

The electrically conductive structures can be metal wires, preferably a copper, tungsten, gold, silver, or aluminum wire. The wire can be equipped with an electrically insulating coating. The electrically conductive structure can, however, also be implemented as a printed conductive layer. The electrical conductivity is, preferably, realized via metal particles contained in the layer, particularly preferably, via silver particles. The metal particles can be located in an organic and/or inorganic matrix, such as pastes or inks, preferably as fired screenprinting paste with glass frits.

To improve the antenna characteristics and, in particular, to increase the length of the antenna conductors, the heating conductors are completely or partially connected to the antenna conductor via at least one capacitive coupling element. For AC signals, the heating conductor is thus a part of the antenna conductor. However, for DC voltages, for heating the pane, the heating conductor remains galvanically separated from the antenna conductor. In the region of the coupling element, antenna conductors and heating conductors are, preferably, spatially close together, preferably parallel, and, particularly preferably with a distance between them of 0.5 mm to 10 mm. The antenna conductor and heating conductor can even mesh with each other in the region of the capacitive coupling in any form, e.g., comb-like or meander-like.

The capacitive coupling is realized according to the invention through electrical conductors that spatially bridge the electrically conductive structures, but without making galvanic contact. The galvanic separation is realized via a galvanic separating layer between the electrically conductive structures and the electrical conductor in the coupling element.

In another preferred embodiment of the invention, an additional intermediate layer is applied between the pane and the electrically conductive structures, preferably, for decorative purposes in the form of a frame on the pane. The intermediate layer, as a black imprint, preferably includes glass frits and black pigments.

In a preferred embodiment of the invention, the capacitive coupling is realized by at least one coupling element.

In a preferred embodiment of the invention, the capacitive coupling is realized by at least two coupling elements that are arranged spatially separated on the pane.

The capacitive coupling elements of the pane according to the invention cover subregions of electrically conductive structures and stretch over at least two subregions of electrically conductive structures. The coupling elements can be partially stretched beyond the electrically conductive structures and be glued directly to the pane. This permits a strong mechanical bond and reduces the adhesion demands on the electrically conductive structures.

The coupling elements can, however, in one embodiment of the invention also be adapted flush with the external outline of the electrically conductive structures. Advantageous in this case is the reduced area and material requirement as well as improved optics.

The coupling elements are preferably applied as film layer systems and/or printed layer systems. The films can, in particular, be self-adhesive. The film layer systems and printed layer systems can have any outline, but can, in particular, be strip-shaped and/or adapted flush with the outline of the electrically conductive structures.

The impedance of the coupling element is substantially determined by the capacitance between the electrical conductor of the coupling element and the electrically conductive structures. Here, the capacitance is a function of the dielectric constants of the galvanic separating layer, the area of the overlap of the electrical conductor and the electrically conductive structures as well as the distances between the electrical conductor and the electrically conductive structures. The highest possible capacitance and thus the lowest possible impedance yield, with the smallest possible intervening distance, a large overlap area and a high dielectric constant. The capacitance can be selected such that interfering frequencies or frequencies that are not needed for the application are not transferred through the coupling element and a high pass or a low pass is obtained.

In a preferred embodiment of the pane according to the invention, the galvanic separating layer includes polyacrylate, cyanoacrylate, methyl methacrylate, silane and siloxane cross-linking polymers, epoxy resin, polyurethane, polychloroprene, polyamide, acetate, silicone adhesive, polyethylene, polypropylene, polyvinyl chloride, polyamide, polycarbonate, polyethylene terephthalate, polyethylene naphthalate, polyimides, polyethylene terephthalate, as well as their copolymers and/or mixtures thereof.

The galvanic separating layer can be made up of a plurality of layers. Advantages of a plurality of layers are increased degrees of freedom in the optimization of the mechanical and electrical properties of the separating layer.

In a preferred embodiment of the pane according to the invention with a printed coupling element, the galvanic separating layer includes a black imprint with a high disruptive strength. The separating layers contain organic and inorganic components, in particular, glass frits and color pigments. The electrical conductor of the printed coupling element preferably contains a conductive paste, a conductive adhesive, and, particularly preferably, a conductive primer. The specific electrical resistance of the printed electrical conductor is less than 1 kOhm*cm, preferably less than 100 Ohm*cm and, particularly preferably, less than 10 Ohm*cm.

The layer thickness of the galvanic separating layer is, preferably, 1 μm to 200 μm and, particularly preferably, 5 μm to 80 μm. The dielectric constant of the galvanic separating layer is, preferably, in the range from 1.5 to 10 and, particularly preferably, from 2 to 6. The disruptive strength for avoiding short-circuits in the galvanic separating layer is, preferably, greater than 1 kV/mm and, particularly preferably, greater than 10 kV/mm.

The electrical conductor of the coupling element preferably includes conductive carbon, conjugated polymers, conductive primer, tungsten, copper, silver, gold, aluminum, and/or mixtures thereof.

In another preferred environment of the invention, the coupling element has an additional protective layer on the electrical conductor, including polyethylene, polypropylene, polyvinyl chloride, or polymethyl methyl acrylate, polyamide, polycarbonate, polyethylene terephthalate, polyethylene naphthalate, polyimide, polyethylene terephthalate, ethylene vinyl acetate, or polyvinyl butyral, as well as their copolymers and/or mixtures thereof. The electrical conductor is protected from the environment by the protective layer. The chemical and mechanical stability of the pane according to the invention with antenna capability and, in particular, the coupling element are increased by the protective layer.

The object of the invention is further accomplished through a method for production of a pane according to the invention with electrically conductive structures, wherein in a first step, a pane with at least two electrically conductive structures galvanically separated from each other is coated. In a second step, a galvanic separating layer is applied at least on one of the electrically conductive structures. In a third step, an electrical conductor is applied on the galvanic separating layer.

In further preferred embodiments of the method according to the invention, the galvanic separating layer and the electrical conductor in at least one capacitive coupling element and, particularly preferably, in at least two capacitive coupling elements are printed on at least one electrically conductive structure or glued on as a film composite.

In a preferred embodiment of the method according to the invention, before the application of the electrically conductive structures, an additional intermediate layer is applied on the pane, preferably in a silkscreen process.

In a preferred embodiment of the method, the galvanic separating layer and the electrical conductor are glued as coupling elements in a film composite on the electrically conductive structures. The film composite is, particularly preferably, self-adhesive. Here, "self-adhesive" means that the coupling element is permanently bonded via an adhesive action of the galvanic separating layer to the electrically conductive structures and/or to the substrate glass.

In another preferred embodiment of the method, the galvanic separating layer is printed in a silkscreen process onto the electrically conductive structures. The electrical conductor is then applied to the galvanic separating layer, preferably in a silkscreen process.

The invention is described in detail with reference to exemplary embodiments, wherein reference is made to the accompanying figures.

Figure 2:
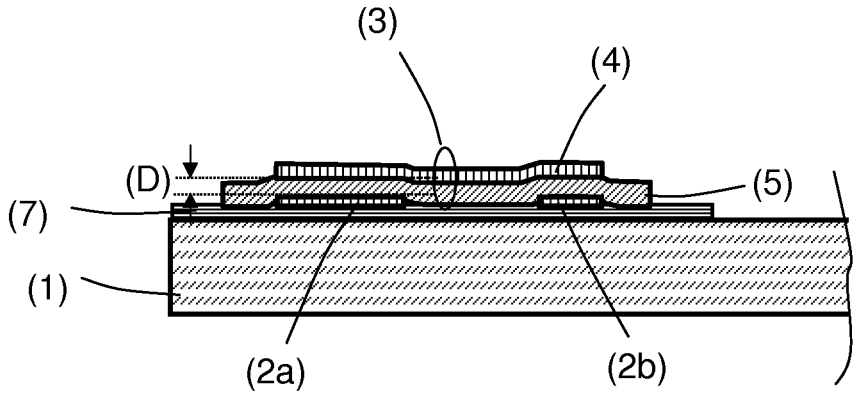
Figure 3:
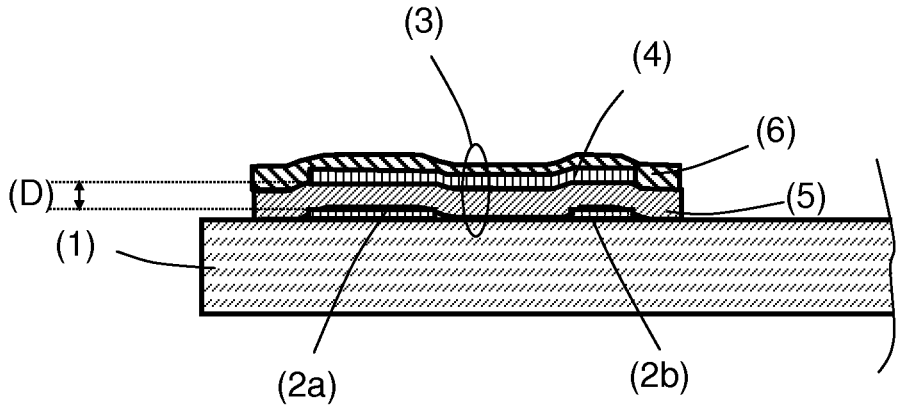
Figure 4:
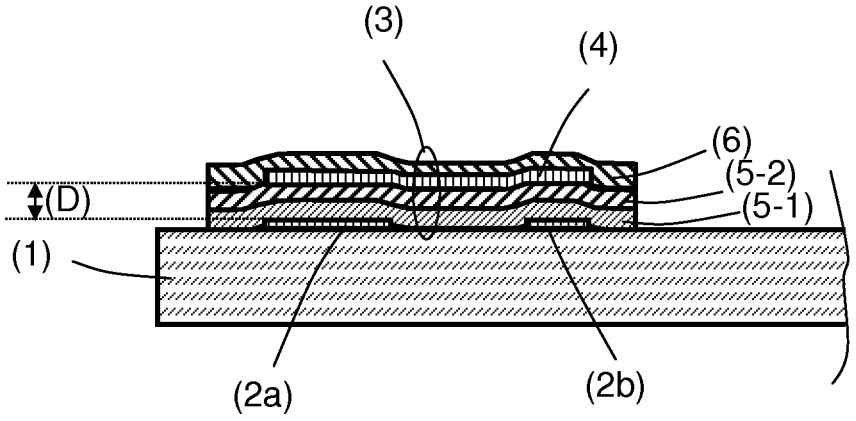
Figure 5:
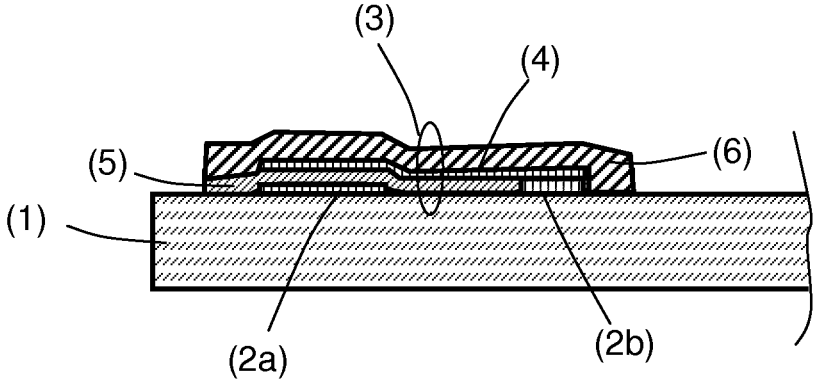
Figure 6:
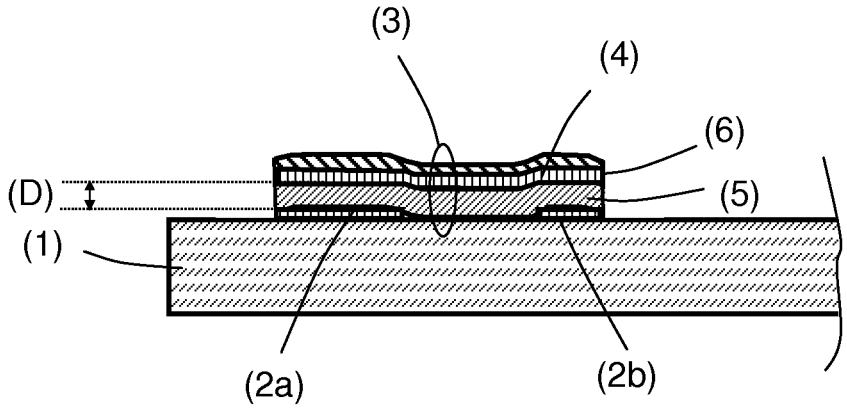
Figure 7:
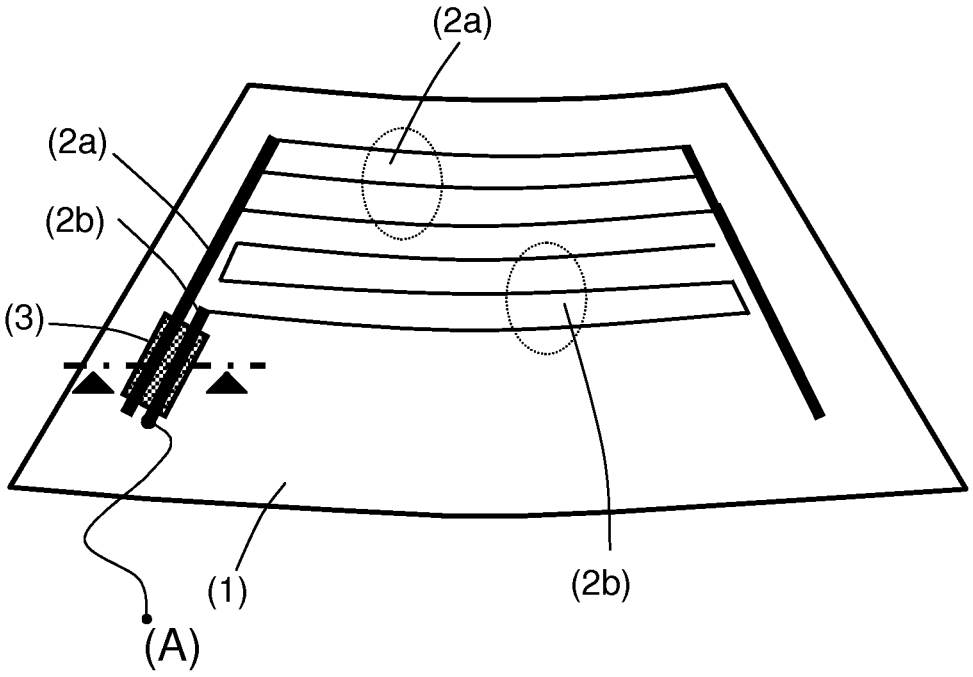
Figure 8:
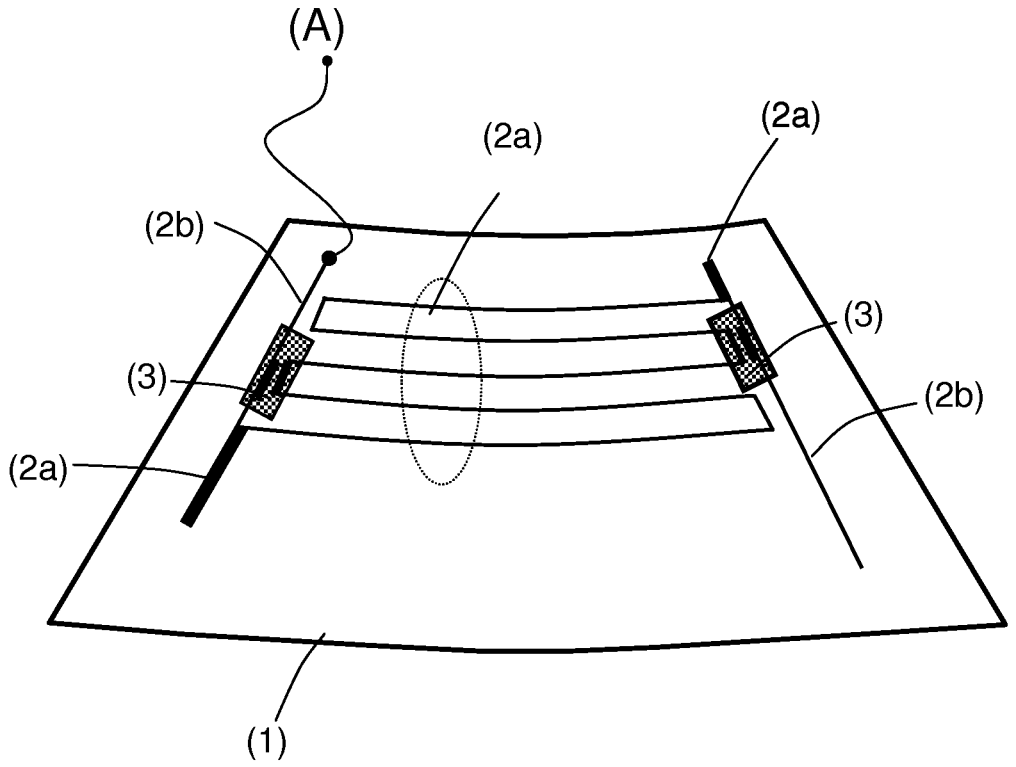
Figure 9:
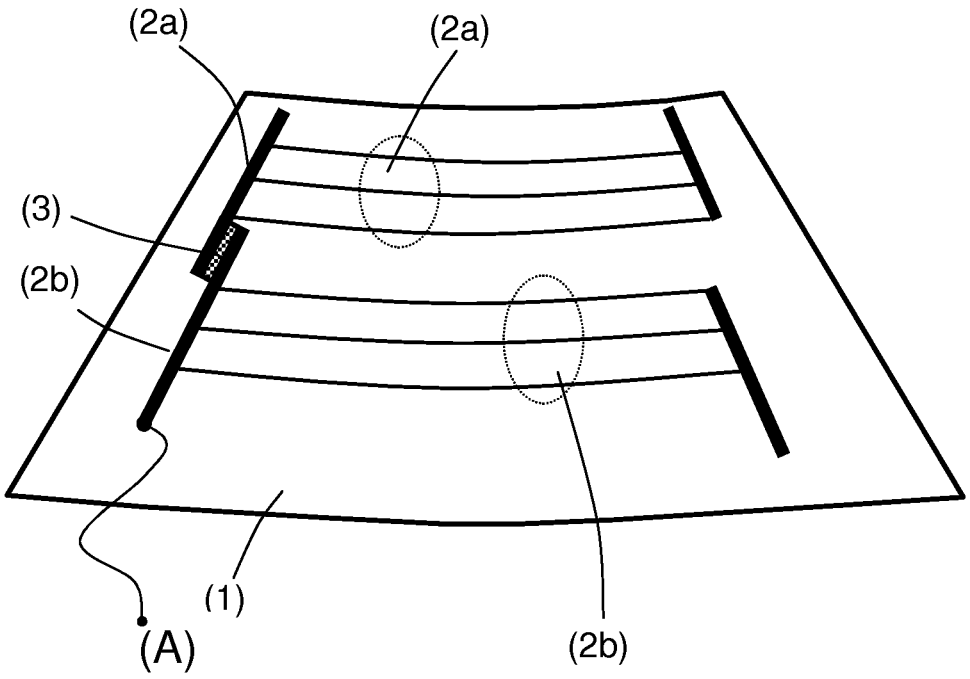
Figure 10:
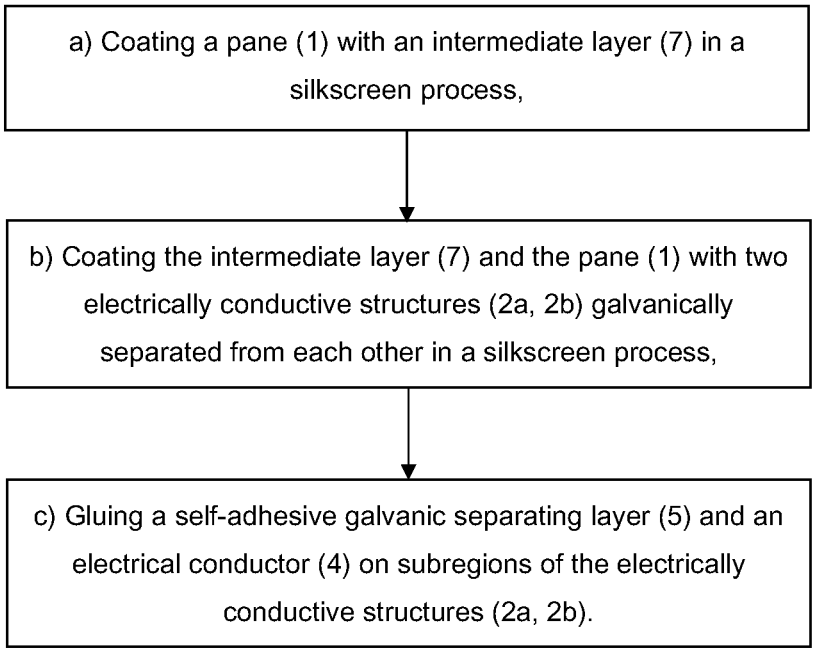
Figure 11:
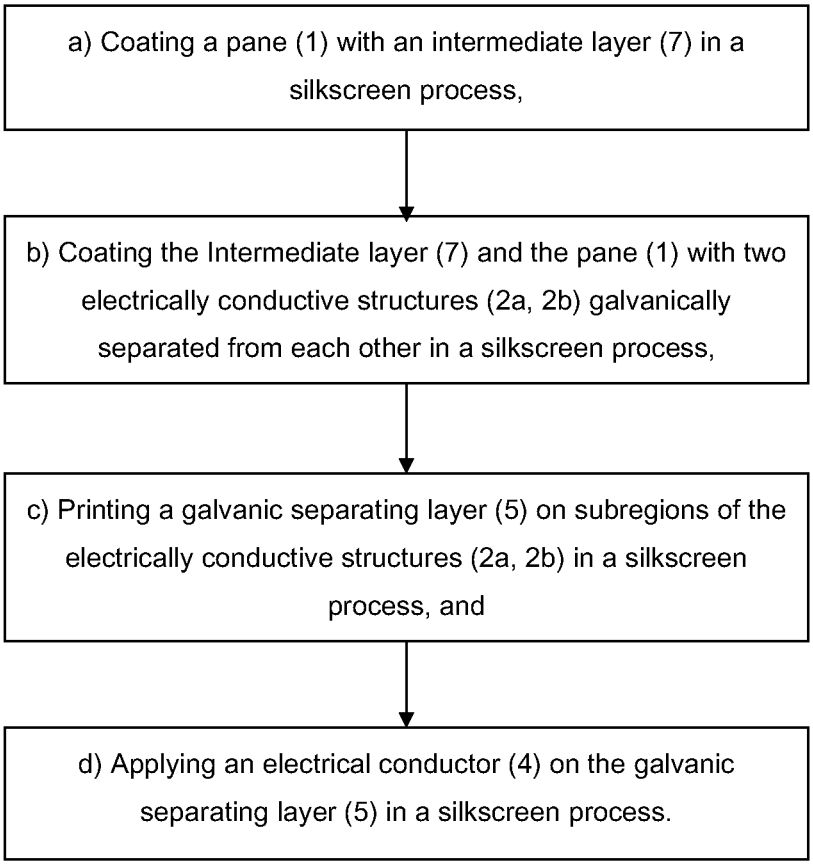

They depict:

FIG. 1 a cross-section through a pane according to the invention in the region of the capacitive coupling, FIG. 2 an alternative embodiment in cross-section in the region of the capacitive coupling, FIG. 3 another alternative embodiment in cross-section in the region of the capacitive coupling, FIG. 4 another alternative embodiment in cross-section in the region of the capacitive coupling, FIG. 5 another alternative embodiment in cross-section in the region of the capacitive coupling, FIG. 6 another alternative embodiment in cross-section in the region of the capacitive coupling, FIG. 7 a plan view of the pane according to the invention, FIG. 8 a plan view of an alternative embodiment of the pane according to the invention, FIG. 9 a plan view of an alternative embodiment of the pane according to the invention, FIG. 10 an exemplary embodiment of steps of the method according to the invention in a flowchart, and FIG. 11 an alternative exemplary embodiment of steps of the method according to the invention in a flowchart.

FIG. 1 depicts a cross-section according to the invention in the region of the capacitive coupling of two electrically conductive structures (2*a*, 2*b*) on a pane (1). The galvanic separating layer (5) separates the electrical conductor (4) from the electrically conductive structures (2*a*, 2*b*). The electrical conductor (4) consisted of one 100 μm thick, electrically conductive primer layer and was applied with a width of 30 mm and a length of 100 mm on the galvanic separating layer (5), such that it covered the busbars of the electrically conductive structures (2*a*) and (2*b*) over the entire width. As the galvanic separating layer (5), a 100 μm thick enamel print with glass frits and black pigments was used that permanently bonded the electrical conductors (2*a*) and (2*b*) and the electrical conductor (4), without producing a direct electrical contact. The galvanic separating layer (5) had a disruptive strength of at least 10 kV/mm. The distance (D) between the electrical conductor (4) and the electrically conductive structure (2*a*, 2*b*) was roughly 70 μm. The dielectric constant of the galvanic separating layer (5) was roughly 6. In this embodiment, it was possible to obtain a further improved capacitive coupling between the electrically conductive structures (2*a*, 2*b*).

With the same available area, it was possible to improve the reception performance of the electrical structures (2*a*), (2*b*) as an antenna with optimized heating properties at the same time.

FIG. 2 depicts another cross-section according to the invention in the region of the capacitive coupling elements (3) of two electrically conductive structures (2*a*, 2*b*), wherein the embodiment of FIG. 1 was enhanced by an additional intermediate layer (7) for decorative purposes. The intermediate layer (7) was applied in the edge region in the form of a frame on the pane (1) and included a 100 μm enamel print with glass frits and black pigments.

FIG. 3 depicts an alternative cross-section according to the invention in the region of the capacitive coupling element (3) of two electrically conductive structures (2*a*, 2*b*). The coupling element (3) included a roughly 45 μm thick copper strip as an electrical conductor (4). The width of the copper strip was 25 mm. The electrical conductor (4) terminated flush with the electrically conductive structures (2*a*, 2*b*) in the width. As the galvanic separating layer (5) between the electrical conductor (4) and the electrically conductive structures (2*a*, 2*b*), a roughly 60 μm thick silicon-based adhesive layer with a dielectric constant of 3 was applied. The distance (D) between the electrically conductive structures (2*a*) and (2*b*) and the electrical conductor (4) was roughly 60 μm. The disruptive strength was at least 10 kV/mm. As a protective layer (6) for the electrical conductor (4) against environmental influences and, in particular, moisture, a roughly 100 μm thick polyethylene naphthalate layer was additionally applied on the electrical conductor (4). The width of the galvanic separating layer (5) and the protective layer (6) was 40 mm. The protective layer (6) along with the galvanic separating layer (5) completely sheathed the electrical conductor (4).

FIG. 4 depicts another construction according to the invention in the capacitive coupling element (3) of two electrically conductive structures (2*a*, 2*b*) on one pane (1). To reduce the demands on the composition of the adhesive layer, the galvanic separating layer (5) was made up of two layers. The lower separating layer (5-1) adjacent the electrically conductive structures (2*a*, 2*b*) included a silicon adhesive with a layer thickness of 30 μm and a dielectric constant of 3. The upper galvanic separating layer (5-2) adjacent the electrical conductor (4) included a polyacrylate adhesive with a dielectric constant of 4 and a layer thickness of 30 μm. By means of the two-layer construction (5-1,5-2), the capacitance between coupling element (3) and the electrically conductive structures (2*a*, 2*b*) could be increased with an unchanged distance (D) and comparable adhesive action compared to the exemplary embodiment of FIG. 3.

FIG. 5 depicts an alternative construction in the region of the capacitive coupling of two electrically conductive structures (2*a*, 2*b*) on one pane (1). No galvanic separating layer (5) was applied on the electrically conductive structure (2*b*). The electrical conductor (4) was galvanically connected to the electrically conductive structure (2*b*). The electrical conductor (4) was galvanically separated from the other electrically conductive structure (2*a*), such that overall the electrically conductive structures (2*a*,2*b*) were also still galvanically separated from each other. In this embodiment, it was possible to obtain an improved capacitive coupling between the electrically conductive structures (2*a*, 2*b*). With the same area, it was possible to substantially improve the reception performance of the electrical structure (2*a*, 2*b*) as an antenna with, at the same time, optimized heating properties compared to the prior art.

FIG. 6 depicts another embodiment of the invention in cross-section. The length and width of the coupling element (3) were precisely adapted to the external outline of the electrically conductive structures (2*a*, 2*b*) in the region of the coupling element (3). In the exemplary embodiment, the coupling element (3) had a width of 25 mm and was able to terminate flush with the external outline of the electrically conductive structures (2*a*, 2*b*). With this embodiment, it was possible to obtain a reduced material requirement and space requirement for the capacitive coupling.

FIG. 7 depicts an exemplary embodiment according to the invention in plan view. On an inner surface of the pane (1), a first electrically conductive structure (2*a*) with heating and antenna capability and a second electrically conductive structure (2*b*) with antenna capability in the shape of a meander as well as a capacitive coupling element (3) were applied. The electrically conductive structures (2*a*, 2*b*) were formed by a silver-containing screen print with layer thicknesses of roughly 30 μm. The line width of the screen print was 0.5 mm. The first electrically conductive structure (2*a*) included heating conductors running parallel to each other with a line width of 0.5 that were electrically connected in parallel in 10 mm wide busbars. In an edge region of the structure (2*a*), the capacitive coupling to the electrically conductive structure (2*b*) of the antenna conductor was produced. On one end of the ant0065nna conductor (2*b*), the signal was forwarded for further processing via an antenna connection (A). The width of the antenna conductor (2*b*) was 0.5 mm and in the region of the coupling element (3) 10 mm. The coupling element (3) had a length of 100 mm and a width of 30 mm and covered the electrically conductive structures (2*a*, 2*b*) to a length of 100 mm. The busbars of the electrically conductive structures (2*a*, 2*b*) were printed on in the region of the coupling element (3) running parallel to each other on the edge of the pane (1). The distance between the electrically conductive structures (2*a*) and (2*b*) in the region of the coupling element (3) was 5 mm. In the width, the coupling element extended beyond the electrically conductive structures (2*a*, 2*b*) on both sides by 2.5 mm in each case.

FIG. 8 depicts an alternative embodiment according to the invention of electrically conductive structures (2*a*, 2*b*) and coupling elements that were applied on a single-pane safety glass (1). The first electrically conductive structure (2*a*) included a meander-shaped heating conductor with a line width of 0.5 mm and 10 mm wide contact regions on the ends. A second electrically conductive structure (2*b*) included two line-shaped conductors with a line width of 0.5 mm that are capacitively coupled via two coupling elements (3) with the electrically conductive structure (2*a*) to form an antenna conductor. At one end of the heating conductor (2*a*), the signal was forwarded via an antenna connector (A) into a receiving device for further processing. The line width of the electrically conductive structures (2*a*,2*b*) was 0.5 mm in the region of the coupling element. The distance between the electrically conductive structures (2*a*, 2*b*) was 5 mm.

FIG. 9 depicts another embodiment according to the invention of electrically conductive structures (2*a*, 2*b*) and coupling elements that were applied on a single-pane safety glass (1). The first electrically conductive structure (2*a*) included heating conductors running parallel to each other with a line width of 0.5 mm that were electrically connected in parallel in 10 mm wide busbars. A second electrically conductive structure (2*b*) also included heating conductors connected in parallel. Via the extended busbars of the electrically conductive structures (2*a*, 2*b*), the structures were coupled capacitively on one side with a coupling element (3). At one end of the heating conductor (2*b*), the signal was forwarded via an antenna connector (A) for further processing. The line width of the electrically conductive structures (2*a*, 2*b*) was 0.5 mm in the region of the coupling element (3). The distance between the electrically conductive structures (2*a*, 2*b*) was 5 mm.

FIGS. 10 and 11 depict in detail the steps of the method according to the invention for production of a pane (10) with electrically conductive structures (2*a*, 2*b*) and coupling elements (3).

In exemplary embodiments of the invention described in FIGS. 1 to 9, a capacitive coupling between the electrically conductive structures (2*a*) and (2*b*) improved compared to the prior art was obtained. Via a capacitive coupling element (3), the electrically conductive structures (2*a*) and (2*b*) were galvanically separated with regard to the heating voltage (DC) and capacitively coupled with regard to the antenna signals (high-frequency AC). On one surface of the pane, the reception performance of the antenna was clearly improved compared to the prior art with optimized heating properties at the same time.

REFERENCE CHARACTERS (1) Pane,
(2*a*),(2*b*) Electrically conductive structure,
(3) Capacitive coupling element,
(4) Electrical conductor,
(5),(5-1),(5-2) Galvanic separating layer,
(6) Protective layer,
(7) Intermediate layer,
(A) Connection point for receiving device,
(D) Distance between the electrical conductor and the electrically conductive structure.

The invention claimed is:

1. A pane with electrically conductive structures, comprising:

a pane with electrically conductive structures each galvanically separated from each other, a galvanic separating layer on at least one of the electrically conductive structures, and an electrical conductor on the galvanic separating layer, wherein the galvanic separating layer galvanically separates the electrical conductor from the electrically conductive structures such that the electrical conductor and the electrically conductive structures are decoupled from each other for direct current voltage, wherein the galvanic separating layer and the electrical conductor are a capacitive coupling element coupling between the electrically conductive structures, and wherein the capacitive coupling element covers subregions of the electrically conductive structures and overlaps, with respect to a normal of a surface of the pane, the subregions of at least two of the electrically conductive structures.

2. The pane according to claim 1, wherein at least one capacitive coupling element is applied on at least one of the electrically conductive structures.

3. The pane according to claim 1, wherein the galvanic separating layer has a dielectric constant of 2 to 6.

4. The pane according to claim 1, wherein the galvanic separating layer includes at least two layers.

5. The pane according to claim 1, wherein the electrical conductor has a layer thickness of 10 μm to 200 μm.

6. The pane according to claim 1, wherein the electrically conductive structures are configured as a comb or mesh with each other as meanders in the region of the capacitive coupling element.

7. The pane according to claim 1, wherein the electrically conductive structures have a layer thickness of 10 μm to 100 μm.

8. A method for producing a pane with electrically conductive layers, comprising:

coating a pane with electrically conductive structures each galvanically separated from each other, applying at least one galvanic separating layer on subregions of the electrically conductive structures, and applying at least one electrical conductor on the galvanic separating layer and overlapping, with respect to a normal of a surface of the pane, the subregions such that the at least one electrical conductor is galvanically separated from the electrically conductive structures such that the at least one electrical conductor and the electrically conductive structures are decoupled from each other for direct current voltage, wherein the galvanic separating layer and the electrical conductor are applied in a capacitive coupling element over at least one of the electrically conductive structures; and wherein the capacitive coupling element on the at least one of the electrically conductive structures is applied in a manner that covers the subregions of the electrically conductive structures and overlaps, with respect to a normal of a surface of the pane, the subregions of at least two of the electrically conductive structures.

9. The method according to claim 8, further comprising additionally applying an intermediate layer to the pane.

10. The method according to claim 8, wherein the applying the capacitive coupling element comprises gluing, in a film composite, the capacitive coupling element on the at least one electrically conductive structure.

11. The method according to claim 8, wherein the galvanic separating layer and/or the electrical conductor are applied by screenprinting, relief printing, gravure printing, flexo printing, or by doctor-blading.

12. A method comprising:

using the pane according to claim 1 as a motor vehicle glazing with antenna and heating capability.

* * * * *

UNITED STATES PATENT AND TRADEMARK OFFICE

CERTIFICATE OF CORRECTION

PATENT NO. : 9,196,949 B2
APPLICATION NO. : 13/377806
DATED : November 24, 2015
INVENTOR(S) : Stefan Droste et al.

It is certified that error appears in the above-identified patent and that said Letters Patent is hereby corrected as shown below:

In the specification,

Column 7, line 19, please delete “the ant0065nna conductor” and replace with “the antenna conductor”.

Signed and Sealed this
Fifteenth Day of March, 2016

Michelle K. Lee

Michelle K. Lee
*Director of the United States Patent and Trademark Office*